US007749087B2

(12) United States Patent
Elias

(10) Patent No.: US 7,749,087 B2
(45) Date of Patent: Jul. 6, 2010

(54) MIRROR MAZE INCLUDING FLOOR LIGHTING

(75) Inventor: Darrin S. Elias, Farmington Hills, MI (US)

(73) Assignee: Amazing Mazes, LLC, Madison Heights, MI (US)

( * ) Notice: Subject to any disclaimer, the term of this patent is extended or adjusted under 35 U.S.C. 154(b) by 607 days.

(21) Appl. No.: 11/680,376

(22) Filed: Feb. 28, 2007

(65) Prior Publication Data

US 2008/0205046 A1 Aug. 28, 2008

(51) Int. Cl.
*A63J 11/00* (2006.01)
*A63G 31/00* (2006.01)

(52) U.S. Cl. ..... 472/62; 472/63

(58) Field of Classification Search ..... 472/59–62, 472/136, 137; 273/275, 283, 284, 292, 294, 273/153 R; 463/6, 7, 58–63
See application file for complete search history.

(56) References Cited

U.S. PATENT DOCUMENTS 4,674,753 A * 6/1987 Hochstim ..... 273/258
5,585,967 A * 12/1996 Monroe ..... 359/629
6,309,306 B1 * 10/2001 Geagley et al. ..... 472/60
6,575,462 B2 * 6/2003 Roy ..... 273/153 R

OTHER PUBLICATIONS

Adrian Fisher Mazes Ltd, "Mirror Mazes_The Visitor Experience" at www.mirrormaze.com.
A-Maze-N Mirrors, "The Mirror Maze by A-Maze-N Mirrors" at www.mirrormazes.com.

* cited by examiner

*Primary Examiner*—Kien T Nguyen
(74) *Attorney, Agent, or Firm*—John A. Miller; Miller IP Group, PLC

(57) ABSTRACT

A mirror maze that employs lighting in the floor of the maze to add to the optical illusion provided by the mirror maze effect. The mirror maze includes the traditional array of pillars and mirrors where lines are provided between the pillars, and where the space between some of the pillars includes a mirror along a line between the pillars and the space between some of the pillars is open. In one non-limiting embodiment, light strips are provided along the lines between the pillars, where a pair of light strips is positioned adjacent to each other between the pillars that do not include a mirror, and a single light strip is provided between pillars that do include a mirror, so that the reflection of the light strip provides the appearance of a pair of light strips.

12 Claims, 2 Drawing Sheets

MIRROR MAZE INCLUDING FLOOR LIGHTING

BACKGROUND OF THE INVENTION

1. Field of the Invention

This invention relates generally to a mirror maze and, more particularly, to a mirror maze that employs specially configured floor lighting.

2. Discussion of the Related Art

A mirror maze is an array of pillars where the space between some of the pillars includes a mirror and the space between other pillars is open. Lines are provided between the pillars so that a triangle is formed between any three adjacent pillars, where each angle in the triangle is about 60°. The mirrors are positioned along the lines. In this orientation, each pillar includes six lines extending from it, some real and some reflected, so that it appears that the pillars are laid out in rows when looking into the maze. Because the mirrors are angled, a person approaches the mirrors at an angle relative to the mirror so that the person does walk straight towards his/her reflection. Such an orientation of mirrors creates an optical illusion that the maze extends into infinity, where it is difficult to tell which of the lines and pillars are real and which of the lines and pillars are reflections from the mirrors. A person will enter the mirror maze at one location and attempt to exit the mirror maze at another location.

As a result of the optical illusion created by a mirror maze, a visitor to the maze will perceive a certain effect and experience as a result of being within the maze. Adding various types of lighting, sounds, smells, etc. to the maze enhances this experience and effect. Designers of mirror mazes are constantly attempting to improve the mirror maze experience by designing mirror mazes that provide various effects and feelings.

SUMMARY OF THE INVENTION

In accordance with the teachings of the present invention, a mirror maze is disclosed that employs lighting in the floor of the maze to add to the optical illusion provided by the mirror maze effect. The mirror maze includes the traditional array of pillars and mirrors where lines are provided between the pillars, and where the space between some of the pillars includes a mirror along the line between the pillars and the space between some of the pillars is open. In one non-limiting embodiment, light strips are provided along the lines between the pillars, where a pair of light strips is positioned adjacent to each other between the pillars that do not include a mirror, and a single light strip is provided between pillars that do include a mirror, so that the reflection of the light strip from the mirror provides the appearance of a pair of adjacent light strips.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a mirror maze employing lighting in the floor between pillars is merely exemplary in nature, and is in no way intended to limit the invention or its applications or uses.

Figure 1:
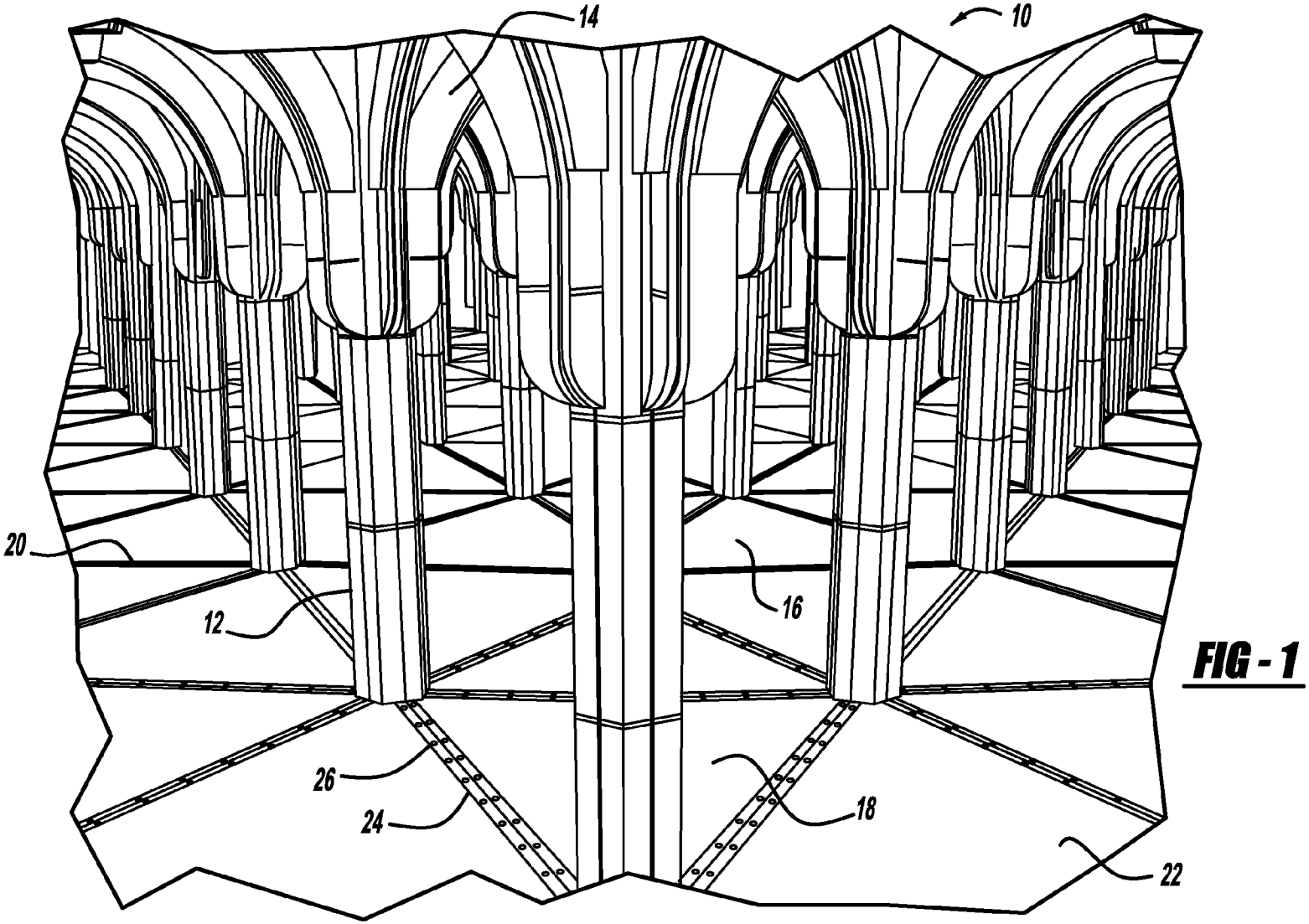
FIG. 1 is a perspective view of a mirror maze including light strips in the floor along lines between pillars, according to an embodiment of the present invention.

FIG. 1 is a perspective view of a mirror maze 10 including an array of pillars 12 arranged in a certain configuration, where arcs 14 extend between the pillars 12 along the ceiling of the maze 10, as shown. The artistic look of the pillars 12 can be any suitable design for a particular mirror maze theme. Further, the pillars 12 can be made of any suitable material, such as wood, fiberglass and poly-resin, and can have any suitable diameter. The mirror maze 10 is specially designed so that some of the spaces between the pillars 12 are open and some of the spaces between the pillars 12 include a mirror 16 to provide an infinitely extending illusion of pillars in the conventional manner. A visitor to the maze will enter the maze 10 at one location and attempt to move through the maze 10 through the openings between the pillars 12 and exit the maze 10 at another location. Certain of the mirrors 16 at an inside of the maze 10 will be double-sided mirrors so that when the person walks around the particular mirror 16, the optical illusion is maintained when the person looks back.

Triangular sections 18 are defined by lines 20 extending between groups of three adjacent pillars 12 in the actual structure of the mirror maze 10 and the optical illusion provided by the mirror maze 10, where each angle of the triangle is about 60°. The mirrors 16 are set along the lines 20 between the pillars 12 in the desired maze design. In this configuration, each pillar 12 has six of the lines 20 extending from it, either an actual line or a reflection of a line, as shown.

As mentioned above, the design of mirror mazes generally includes the addition of light and sound to the maze to increase the overall maze effect and experience, and add to the optical illusion. Known mirror mazes typically include various types of lighting, all of which is provided from or within the ceiling of the maze. The lighting could include various types and configurations of lights, such as colored lights, blinking lights, moving lights, lights set to music, etc. The known lighting designs for mirror mazes cause the light to be reflected off of the pillars, mirrors and floor, thus creating a certain look and feel about the mirror maze for a particular theme.

Figure 2:
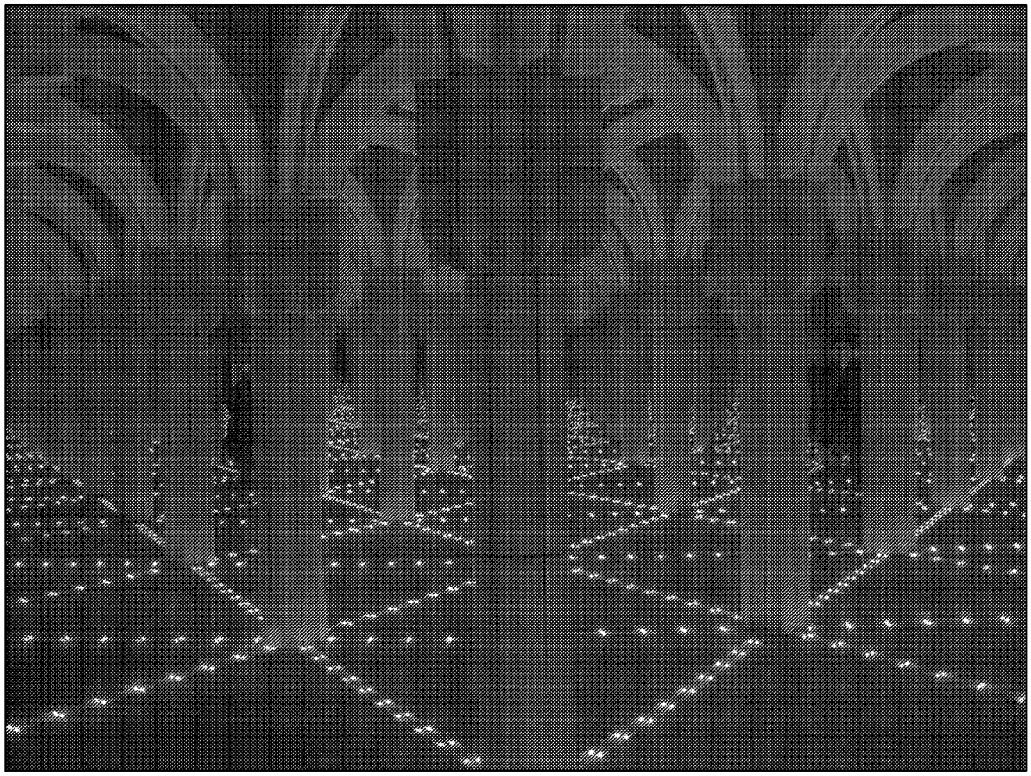
FIG. 2 is a photograph of a mirror maze including the light strips shown in FIG. 1.

According to the invention, the mirror maze 10 includes lighting on or in a floor 22 of the maze 10 on which the mirror maze guests walk. By providing the lighting on the floor 22 of the maze 10, the light is directed upwards and is reflected off of the pillars 12 and ceiling, creating a different effect than providing lighting on the ceiling. By maintaining the rest of the mirror maze 10 darkened, the mirror maze illusion provided by the mirrors 16 is further enhanced to provide a different look and feel using the floor lighting. FIG. 2 is a photograph of a mirror maze having the same design as the mirror maze 10 including lights on the floor 22 to show the visual effect created by one type of floor lighting.

The present invention proposes any suitable floor lighting that enhances the mirror maze illusion and experience. In one non-limiting design, the mirror maze 10 includes light strips 24 provided along the lines 20 between the pillars 12. The light strips 24 include spaced-apart lights 26, such as LEDs. For those lines 20 between the pillars 12 that do not include a mirror 16, a pair of adjacent light strips 24 is provided. For those lines 20 between the pillars 12 that do include a mirror 16 only a single light strip 24 is provided. The single light strip 24 is reflected off of the mirror 16 to provide the appearance that it is two adjacent light strips, which adds to the optical illusion provided by the mirror maze effect.

Other types of light strips can also be provided along the lines 20 between the pillars 12. For example, continuous lights, such as light ropes can be provided along the lines 20. Further, the lights 26 can be any suitable lights for the purposes discussed herein. The lights 26 can vary in intensity, size, color, etc. The lights 26 can be electrically controlled to blink or flash, either in sync with music or at a predetermined frequency.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. A mirror maze comprising:

an array of pillars, where lines are defined between the pillars;

a plurality of mirrors positioned along the lines between some of the pillars; and at least one light strip positioned along the lines between the pillars, wherein a pair of adjacent light strips are provided along the lines between pillars that do not have a mirror and a single light strip is provided along the line adjacent to the mirror for those lines that do have a mirror.

2. The mirror maze according to claim 1 wherein the light strips include spaced apart lights.

3. The mirror maze according to claim 2 wherein the lights are LEDs.

4. The mirror maze according to claim 1 wherein the light strips include continuous lights.

5. The mirror maze according to claim 1 wherein the light strips include lights that flash in a predetermined manner.

6. The mirror maze according to claim 1 wherein the only lights in the maze that contribute to the maze effect are on a floor of the maze.

7. The mirror maze according to claim 1 wherein the pillars are oriented so that the lines between three adjacent pillars define a triangle having 60° angles.

8. The mirror maze according to claim 1 wherein the array of pillars and the plurality of mirrors provide six true or reflected lines extending from the pillars.

9. The mirror maze according to claim 1 further comprising arcs extending between the pillars at a top of the pillars.

10. A mirror maze comprising:

an array of pillars where a line is defined between adjacent pillars, said pillars being oriented so that the lines between three adjacent pillars define a triangle having 60° angles;

a plurality of mirrors positioned along the lines between some of the pillars, wherein the array of pillars and the plurality of mirrors provide six true or reflected lines extending from the pillars; and at least one light strip positioned along the lines between the pillars, each light strip including a plurality of spaced-apart lights, wherein a pair of adjacent light strips are provided along the lines between pillars that do not have a mirror and a single light strip is provided along the line adjacent to the mirror for those lines that do have a mirror, and wherein the only lights in the maze that contribute to the maze effect are on a floor of the maze.

11. The mirror maze according to claim 10 wherein the lights are LEDs.

12. The mirror maze according to claim 10 wherein the light strips include lights that flash in a predetermined manner.

* * * * *